US005265386A

United States Patent [19]

Mühlethaler

[11] Patent Number: 5,265,386

[45] Date of Patent: Nov. 30, 1993

[54] METHOD AND DEVICE FOR LAYING ACCESS FLOORS, AND ACCESS-FLOOR SUPPORT

[75] Inventor: Erhard Mühlethaler, Schalunen, Switzerland

[73] Assignee: Zurecon AG, Zurich, Switzerland

[21] Appl. No.: 765,762

[22] Filed: Sep. 26, 1991

[30] Foreign Application Priority Data

Oct. 3, 1990 [CH] Switzerland ..... 03178/90
Jan. 22, 1991 [CH] Switzerland ..... 00174/91

[51] Int. Cl.[5] ..... E04D 15/00

[52] U.S. Cl. ..... 52/126.6; 52/263; 52/749

[58] Field of Search ..... 52/126.6, 263, 749

[56] References Cited

U.S. PATENT DOCUMENTS 4,676,036 6/1987 Bessert ..... 52/126.6
4,942,708 6/1990 Krumholz et al. ..... 52/126.6

FOREIGN PATENT DOCUMENTS 0073184 6/1977 Australia ..... 52/126.6
0077070 10/1982 European Pat. Off. .
2915115 12/1979 Fed. Rep. of Germany ..... 52/126.6
1306680 9/1962 France ..... 52/126.6
1340037 12/1973 United Kingdom ..... 52/126.6

*Primary Examiner*—Carl D. Friedman
*Assistant Examiner*—Wynn E. Wood
*Attorney, Agent, or Firm*—Browdy and Neimark

[57] ABSTRACT

To simplify and speed up the laying of access floors formed of floor panels (6) laid on supports (5) set out in a regular pattern, an ancillary plane (4) extending over a field (3) of grid points (2) is levelled up at a distance from the subfloor or structural slab (1). A device (10) with a frame (11) and outriggers (12) is used to define the ancillary plane, to hold temporarily a multiplicity of supports (5) and introduce them simultaneously. The supports are then simultaneously adjusted in height and fixed on the grid points (2) in accordance with the respective distance between the ancillary plane and the (uneven) subfloor (1). The supports are then released from the device (10), the device is removed, and the panels (6) are laid on the accurately positioned head pieces of the supports. Various embodiments of the method, the device (10), and particularly suitable prefabricated supports (5) are described. In the latter, the head piece and base are loosely guided relative to each other and can be moved axially relative to each other without the need of rotating either the head piece or the base. After height adjustment of the supports, means of retention and fixation are used to fix the relative position of the parts to each other.

28 Claims, 4 Drawing Sheets

Fig. 3
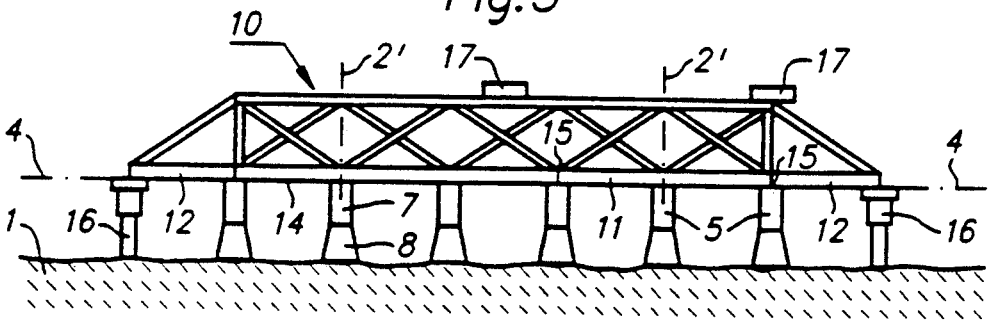
Fig. 4
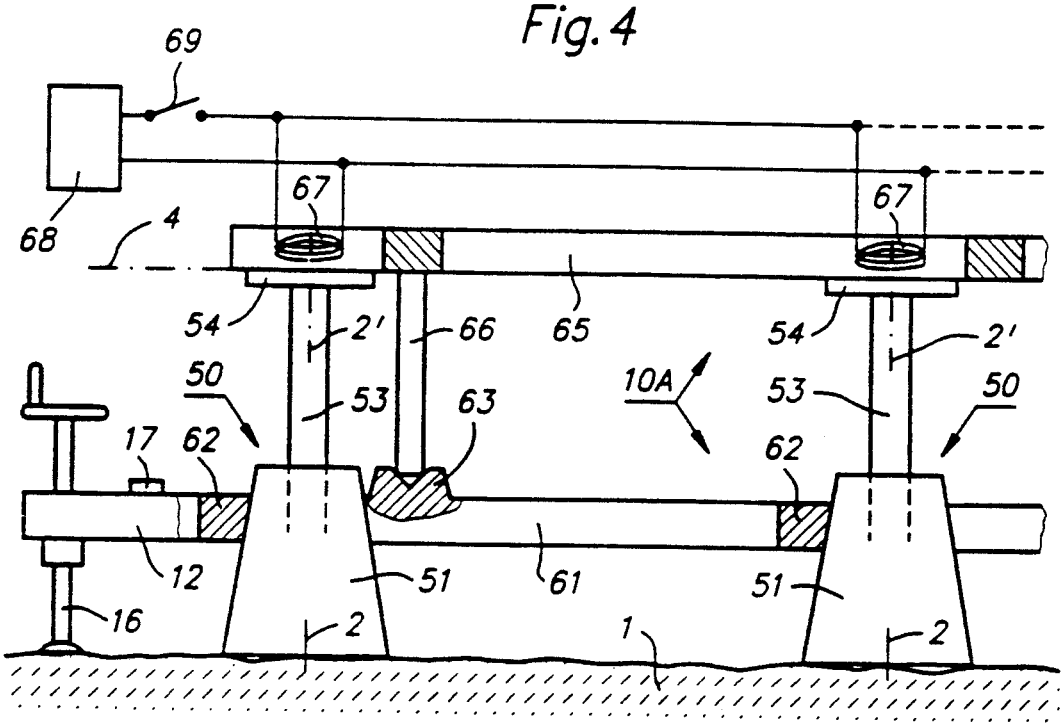
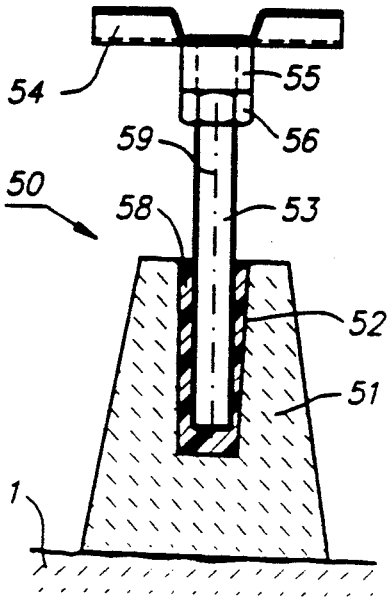
Fig. 9

METHOD AND DEVICE FOR LAYING ACCESS FLOORS, AND ACCESS-FLOOR SUPPORT

BACKGROUND OF THE INVENTION

Access floors, also known as sectional false floors, consist mainly of floor panels laid edge to edge and carried on height-adjustable load-bearing supports which are set out in a regular grid and stand on a subfloor or structural slab. Such access floors are provided mainly in buildings for office, administrative, industrial, commercial, and trade use, in order to allow use of the void under the floor panels for free layouts of a wide variety of services: electrical mains, telephone, control, and data cables; pipework and ducting for ventilation, air conditioning, heating, hot and cold water supply, and the like. The floor panels can be lifted out separately and provide ready access to such installations, allowing them to be modified at any time to adapt to changes in user requirements.

Conventional procedures of installing and laying access floors are extremely laborious and time-consuming, and high labour costs make them correspondingly expensive. Structural slabs and subfloors are built to large tolerances and are usually far from level, smooth, or even. Such unevenness and differences in level have to be compensated when the supports or feet are set out or fitted to carry the floor panels, so as to form an accurate, perfectly horizontal bearing plane at the proper height for the floor panels. Conventional procedures require the subfloor to be accurately measured and the grid laid out on it; each support must then be positioned on the subfloor at a grid intersection, secured in place, and its height accurately adjusted. Despite unevenness in the subfloor, each support must stand absolutely plumb on its grid point; for this purpose, its foot has to be wedged up or the support has to be provided with some form of movable joint. All the supports known to date have screw threads to permit height adjustment. Usually, the height is adjusted by using of a floor panel which is laid across adjacent supports already adjusted and the new support to be set up; the panel is then checked by means of a spirit-level. This procedure requires the heavy floor panels to be removed and replaced repeatedly. To date, therefore, the assembly of access floors has been an extremely laborious task that demands heavy physical labour at or near floor level and makes only slow progress even when carried out by skilled workers.

BRIEF SUMMARY OF THE DISCLOSURE

A principal object of the present invention is to permit a considerable acceleration of the progress of work as compared with conventional methods and to lighten and simplify this work to a significant degree, in order to avoid the known severe fatigue and health hazards to operatives, such as damage to the back and joints.

The invention relates to a method for the assembly or laying access floors that comprise floor panels laid onto and resting edge to edge on height-adjustable load-bearing supports, the latter being set out in a regular grid pattern and standing on a structural slab or subfloor. The method according to the present invention meets the above-mentioned objects by comprising the following steps:

an ancillary plane, extending over a field comrising a plurality of grid points, is levelled at a given distance above the subfloor;

prefabricated supports, each having a head piece and a base, are introduced on said grid points between the ancillary plane and the subfloor;

said supports at each of said grid points are adjusted to the required height to suit the respective distance between the ancillary plane and the subfloor, and the head piece and base of each said support are fixed to each other;

and, finally, the floor panels are laid onto the fixed supports.

In accordance with the invention, therefore, the supports are no longer adjusted individually by being built up from the uneven subfloor. Instead, they are adjusted in groups below the exactly levelled ancillary plane that acts as a reference plane for the height (which may vary according to the unevenness of the subfloor) of a plurality of supports at a time. The ancillary horizontal plane can coincide with the bearing plane of the floor panels or may be parallel to it. It may, for example, be below said bearing plane, in which case an additional or intermediate bearing element of uniform height is fitted on each adjusted support before the floor panels are laid on the head pieces.

The invention further relates to a device that permits the method described above to be carried out. This device has a frame which defines the ancillary plane over the field and which, according to the invention, comprises:

height-adjustable supporting elements for positioning the device above said subfloor; and releasable attachment means for releasably fixing the head pieces of said prefabricated supports aligned in height with the ancillary plane and extending perpendicularly therefrom at points on the frame corresponding to said grid points.

Such device according to the invention allows the supports to be introduced, set up and levelled in groups, whereby the vertical position and alignment of the supports on the grid points are determined for the whole group when levelling of the frame that defines the ancillary plane is achieved.

Finally, the invention relates to a prefabricated access-floor support specially designed and particularly (but not exclusively) suitable for use with the above-mentioned method and device according to the invention. This access-floor support has a base and a head piece which, for the purpose of height adjustment of the support, are adjustable relative to each other. In accordance with the present invention, such support is characterized in that the head piece and the base are guided loosely relative to each other, and are continuously adjustable in the support's axial direction without requiring rotation of either the head piece or the base, and is further characterized in that fixing means are provided for permanently fixing a relative position of head piece and base.

By contrast with known supports having screwthread adjustment, the access-floor support in accordance with the invention permits simultaneous height adjustment of several such supports, and such adjustment can be made at the same time as levelling the ancillary plane.

PRIOR ART

From the European Patent Application EP-A-0 077 070, a device is known which is intended to compensate unevenness in a subfloor before assembly of an access floor. The device can travel over the subfloor and has clamping means for holding prismatic rods of semifinished material. These rods are lowered one at a time on a grid point of the subfloor and secured thereto by adhesive; when the adhesive has set, a circular saw is used to cut them off at the required height. In this manner, plinth elements are formed on the subfloor at a given level. Only after such preparatory work and without further use of the device, one-piece supports themselves, all of the same height, are set up on the plinth elements. The supports themselves then have to be fixed onto the plinth elements before the panels can be laid on top of the supports.

In contrast to the known device and procedure described above, the present invention provides for prefabricated supports of special design having telescopically adjustable head piece and base, to be introduced in the device, set on the grid points, adjusted in height, and fixed. The supports are thus specifically adapted for use with this method and device, whereby work is considerably speeded up and simplified.

Specific and suitable embodiments of the method in accordance with claim 1, of the device in accordance with claim 6, and of the access-floor support in accordance with claim 12 are indicated below in the respectively dependent claims.

Preferred and typical embodiments of the present invention are described in detail hereafter by reference to and in conjunction with the drawings.

BRIEF DESCRIPTION OF THE DRAWINGS

FIG. 3 is an elevation as seen in the direction indicated in FIG. 2 by an arrow III (supports already set up and fixed, and floor panels already laid omitted);

FIG. 4 is a part elevation, partly in section, of a further embodiment of a device, in conjunction with supports in accordance with FIG. 9;

FIG. 9 is an elevation, with the base in section, of a further embodiment of an access-floor support;

DETAILED DESCRIPTION OF THE INVENTION

Figure 1:
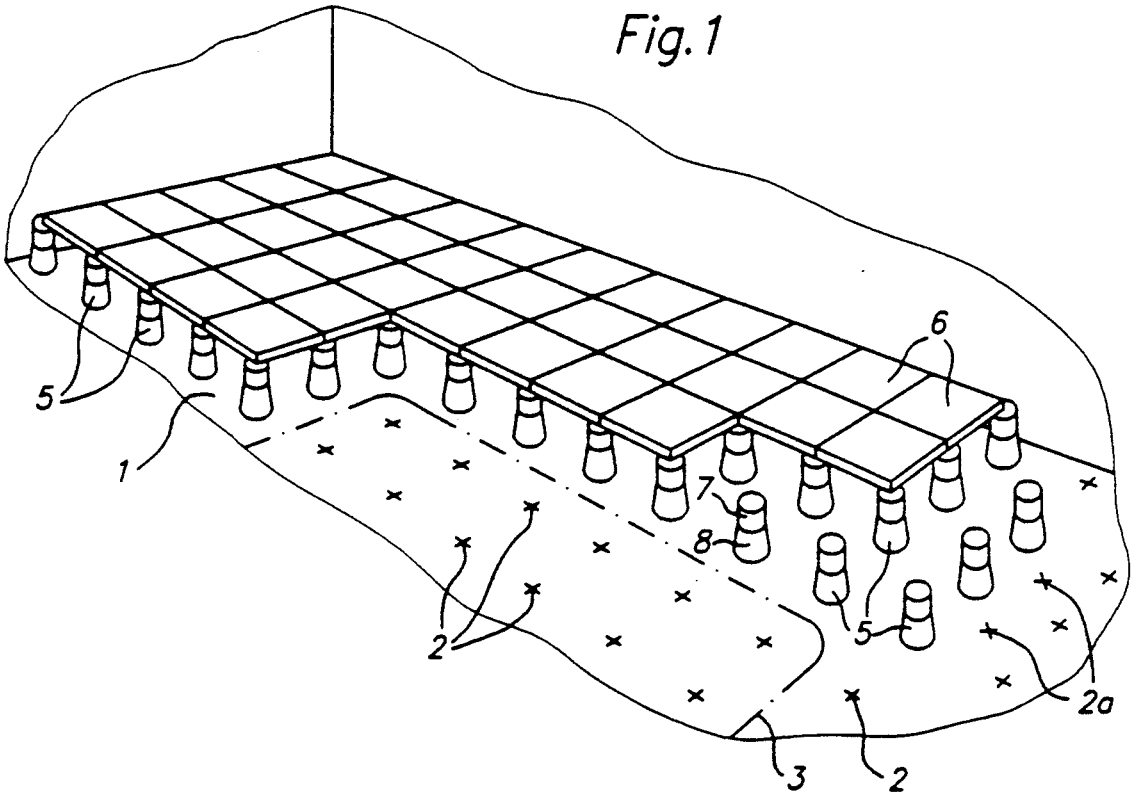
FIG. 1 is a schematic perspective view showing an access floor under construction.

FIG. 1 shows an access floor of which a part is in the process of being laid (assembled) and part is already laid, for example starting from a wall of a room. The access floor shown has supports 5 standing on the subfloor (or structural pad) 1 and set out on a regular grid. These supports carry floor panels 6 laid edge to edge, the adjacent corners of four panels being carried on a single support 5. Square panels are normally used, having, for example, 600 mm long sides, but other shapes and sizes may also be used, and the grid on which the supports are set out is necessarily determined by the shape and size of the floor panels. Numeral 2 indicates grid points or positions on the subfloor 1 on which supports have not yet been set up. As shown on the right in FIG. 1, additional supports may be placed within the grid squares in grid positions *2a*, for example for floor panels 6 subjected to particularly heavy loads. Because the subfloor is usually uneven and/or not completely level, the height of the supports 5 must be adjustable. Further, the longitudinal axis of each support must be perfectly plumb and exactly on the grid point even when the subfloor is uneven. Both the above conditions must be met to ensure that the panels 6 carried by the supports 5 present a perfectly horizontal, even floor surface at the required height.

Figure 2:
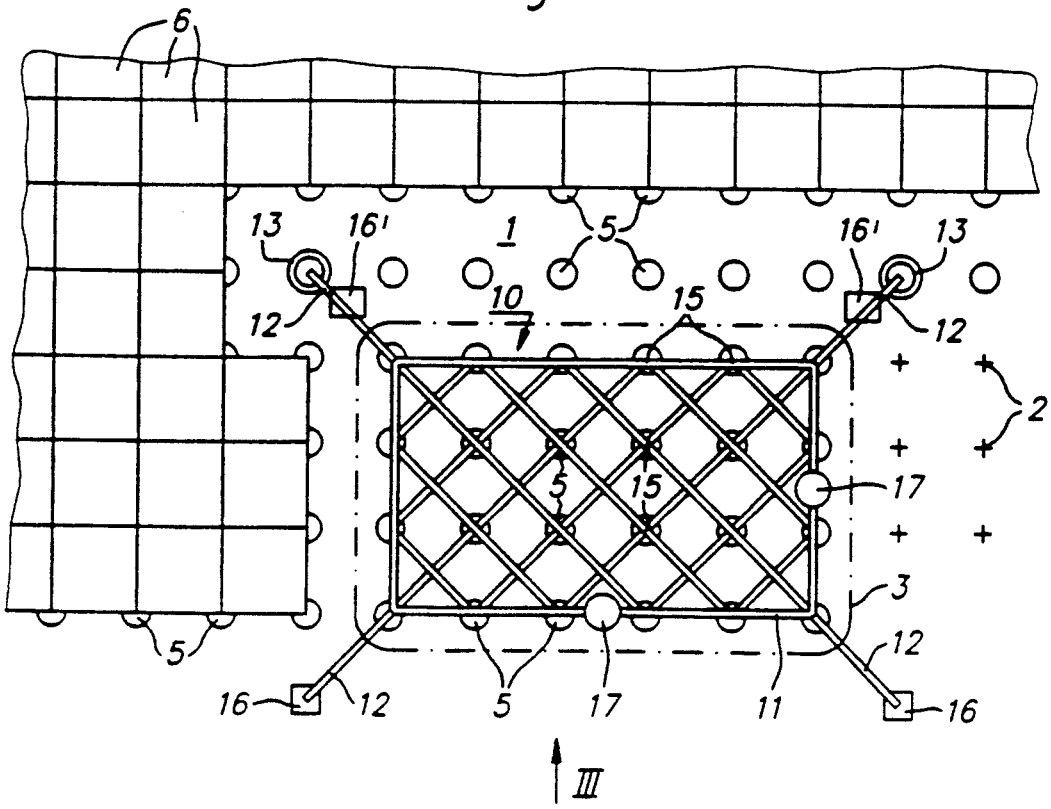
FIG. 2 is a plan view of a similar situation as shown in FIG. 1 and shows a device used for laying the access floor.

FIGS. 1 to 3 show the supports in a greatly simplified form, each with a head piece 7 and a base or plinth 8, which are adjustable relative to each other in order to permit the height adjustment of the supports. The upper extremities of the supports 5 may be connected to each other in a known manner by horizontal struts or braces (not shown) parallel or coinciding with the edges of the floor panels and/or diagonal thereto. Further, after the supports have been set up in position and adjusted in height, intermediate layers or pads (not shown) may be provided to be placed on top of the head pieces 7 of the supports, and on which the floor panels are then laid.

FIG. 2 and 3 show an example of the method proposed by the present invention and an embodiment of an auxiliary device used therefor: Over a field 3 which extends over a plurality of grid points 2 (see also FIG. 1), an ancillary plane 4 (FIG. 3) is levelled at a given, required distance above the subfloor 1; the field 3 may extend over a single row of grid points only or, as shown, across several rows of grid points. The height of the ancillary horizontal plane 4 is of course related to the required level of the floor panels 6, i.e. the level of the ancillary plane may be the same as that of the underside of the panels 6 or it may be different if, as aforesaid, an intermediate pad is placed on top of each of the supports 5 after their height has been adjusted. To the given and levelled ancillary plane 4 in the field 3, the height of the prefabricated supports 5 is then adjusted and fixed in accordance with the (variable) distance between the (uneven) subfloor 1 and the ancillary plane 4. Finally, the floor panels 6 are laid on the previously adjusted and set-up supports, either field by field or subsequently on a larger continuous area of floor.

In order to carry out the method described above, use of a device is appropriate, such as the embodiment shown in FIGS. 2 and 3. A preferred embodiment of the device 10 has a frame 11 of braced grid design made to resist twisting and bending, such frame defining the ancillary plane 4. Supporting elements or legs 16, 16' adjustable in height are used for positioning and levelling the device 10 above the field 3 in a manner described below. Further, the device 10 has releasable means of attachment 15 (which in the present example are not shown in detail) for the head pieces 7 of the supports 5. These means of attachment 15 are used for temporarily fixing the supports 5—or at least their head pieces 7—in positions 2' (FIG. 3) on the frame 11 which correspond to the grid points 2, and that in such a manner that the head pieces 7 are aligned at the level of the ancillary plane 4 and extend perpendicularly therefrom.

In the embodiment shown, the device 10 has four outriggers or cantilevers 12 which extend laterally from the rectangular frame 11. For the positioning of the device 10 on the floor, the outriggers 12 are either aligned with and set up on previously set-out adjacent supports 5, as shown at the top of FIG. 2, or they are fitted with height-adjustable supporting legs 16, as shown at the bottom of FIG. 2. In view of various possible applications for the device, a preferred embodiment has removable supporting legs 16. Similar supporting legs 16, may also be provided on the outriggers 12 described above, which are used for alignment with adjacent supports 5, as shown at the top of FIG. 2. In the embodiment shown in FIG. 2, the ends of the outriggers without supporting legs 16' are carried on the supports previously set up in position, and the height of these supports is adopted by the device 10. For the lateral positioning of the device 10 over the field 3 which is to have the supports fitted, the outriggers 12 may have collars 13 or some other such means, as indicated, which fit over the supports 5 used for reference. The device 10, and therewith the ancillary plane 4, can then be levelled by the vertical adjustment of the supporting legs 16 on the other outriggers 12. For this purpose the device 10 may be provided with levelling elements 17, e.g. spirit-levels. The method may be carried out by manual adjustment of the supporting legs, for example by screw-thread spindles, and simultaneous observation of the levelling elements 17, but it may also be automated, for example by the use of electronic levelling devices and, for example, by supporting legs 16 which are adjustable pneumatically or by means of a screw thread and stepmotor drive. For levelling, it is by no means necessary to use previously set-up and adjusted supports for reference; the ancillary plane can also be levelled by means of a reference system extending over the entire floor surface of the room, for example by an optical laser beam system. Supplementary supporting legs 16' are used particularly at the beginning of a job in a given room, when reference supports 5 are not yet available. For ease of handling and mobility, the device 10 may be equipped with retractable wheels or castors, swivel rollers, and the like.

The use of a device 10 is particularly desirable because it can hold a multiplicity of supports 5 (or at least their head pieces) within a given field 3, position them together and all at the same time on the grid points 2, and keep them perfectly plumb in place. There are various possibilities for adjusting the height of the supports thus introduced: If levelling is done by lowering the ancillary plane 4 toward the subfloor 1, i.e. by lowering the device 10 from above, height adjustment can be practically automatic and simultaneous with levelling, by the shortening of the supports introduced. For this purpose, telescopically adjustable supports are particularly suitable, as described below in various typical embodiments. Regardless of the levelling procedure used, whether by raising or lowering the device 10, the height adjustment of the supports introduced may also be effected, once the ancillary plane 4 has been levelled, by extending and lowering the (previously retracted) supports starting from the ancillary plane 4. For this latter adjustment method, one can use either conventional supports whose height is adjustable by screw thread, or telescopically adjustable supports; the latter are faster and easier to adjust.

The base 8 of each support which rests on the subfloor 1 has to be secured in place. This may be done by a known means, particularly by means of a suitable adhesive to bond it into place. The attachment means 15 referred to above, for securing the head piece of the supports 5 to the device 10, are provided at points 2' (FIG. 3) which correspond to the grid points 2 of the field 3. These means of attachment should be made in such a way that after the supports have been set up in position, adjusted, and fixed, the supports can be readily released and thus allow the device 10 to be lifted off and positioned over the next field 3. The supports may be attached to and released from the device by mechanical or electromagnetic means, compressed air, etc.

A further possible procedure is to set up, adjust the height of, and fix at least three supports 5 first of all in a marginal area of a field 3, to define the ancillary plane 4. The other supports 5 are then introduced in the field 3, adjusted to the previously levelled ancillary plane, and fixed. This procedure is based on the use of two different elements (not shown) of the device after each other, i.e. a "measuring frame" which is used only to set up and adjust the first supports and thus define the ancillary plane, and an "assembly frame", which is then used to introduce the other supports. The latter is not intended for use in levelling but is aligned with the first supports set up as described above.

Yet another version of the device is shown schematically in FIG. 4, in conjunction with supports 50 in accordance with FIG. 9. The device 10A of FIG. 4 has a bottom section 61 and a top section 65, both constructed as grid-like frames. The bottom section 61 can be aligned and levelled as described above, for example by means of supporting legs 16 and spirit-levels 17 or similar. It has stops 62 for the bases 51 of the supports 50, so that, when the bottom section 61 is laterally aligned, the bases 51 will become placed above the grid points 2 on the subfloor 1. The top section 65 can be set on the bottom section 61 by means of legs 66 (only one of which is shown) fitting into centering elements 63 on the bottom section. When the bottom section 61 is levelled, the underside of the top section 65 defines the ancillary plane 4. The top section 65 has releasable attachment means to hold the head pieces 53, 54 of supports 50 temporarily in the positions 2' that correspond to the grid points 2. As a typical embodiment of such means of attachment, electromagnets 67 are indicated schematically, supplied from a power source 68, which simultaneously release all the head pieces when the switch 69 is opened.

The method of working with the device 10A is as follows: Firstly, the bottom section 61 is laterally positioned and then levelled at the required height. With the aid of the stops 62, the bases 51 of the supports are then set up on the grid points 2 and secured to the subfloor 1, for example by adhesive. The head pieces of the supports are then attached to the top section 65, preferably still separate from the bottom section, which is then set on the bottom section 61. The shaft 53 of each top section fits very loosely into a hole 52 (FIG. 9) in the support's corresponding base 51. All the supports are then at the required height in accordance with the distance of the ancillary plane 4 from the subfloor 1. The very loose fit allows the bases to tilt in accordance with the unevenness of the subfloor 1. Adhesive, quick-setting grout, or some other pourable hard-setting material 58 is then introduced into the hole of each support 50, to fix the base and head pieces in position relative to each other. Finally, when the adhesive 58 has set, the means of attachment 67 are released, thereby leaving the set-up and adjusted supports in the field free. Further details of the supports 50 are given below in connection with FIG. 9.

For use of the method described in conjunction with the device 10 or 10A, FIG. 5 to 11 show typical embodiments of particularly suitable designs of access-floor supports. Each of these prefabricated supports has a head piece and a base which are adjustable relative to each other and thus permit the support to be adjusted in height. By contrast with conventional supports, whose head piece and base are fitted together by a screwed connection for height adjustment, the supports shown here are characterized by having a head and a base which are guided loosely relative to each other and whose total length or height is continuously variable by virtue of sliding or displacing the component parts against each other, however without the need to turn them relative to each other. Further, these supports have a means of fixation that permits an attained relative position of the head piece and base to be fixed.

Figure 5:
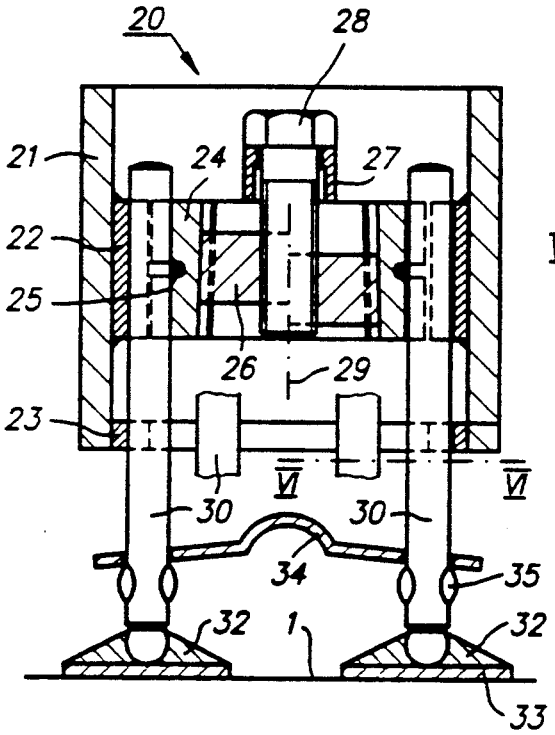
FIG. 5 is a vertical section showing a first embodiment of a suitable access-floor support.
Figure 6:
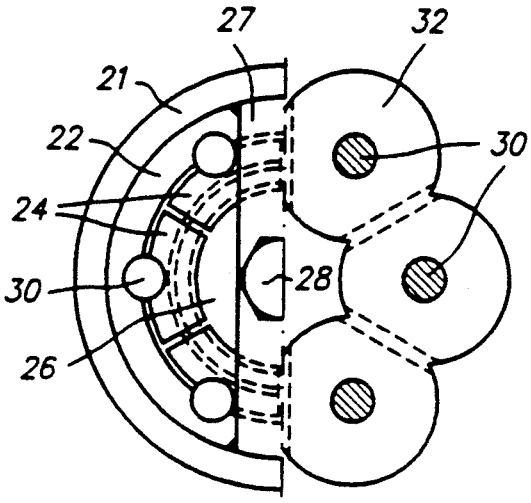
FIG. 6 on the left is a plan view onto the support of FIG. 5, and on the right is a horizontal section along line VI—VI in FIG. 5.

In the embodiment of an access-floor support 20 shown in FIG. 5 and 6, the main component of the head piece 21 is a piece of tubular section. The base is formed by a plurality of rods 30 arranged parallel about the support's centreline 29; FIG. 6 shows a typical embodiment with six such rods 30, but in any case there must not be fewer than three of these. The head piece 21 has a fixed ring 22 and a lower guide ring 23 projecting inside from the inner face of the tubular section. Both rings have semicircular holes that match the diameter of the rods 30, in which the rods are separately guided to move in a longitudinal direction along the inner face of the tubular section. At the height of the ring 22 and radially inside the rods 30, there is a set of six clamping jaws 24, each of which has a matching semicircular hole for its rod. For example, the six clamping jaws 24 shown in FIG. 5 are held loosely together by a spring-loaded wire ring 25 and can move radially. The inside face of the clamping jaws is a uniformly conical surface coacting with the corresponding conical outer face of a clamping block 26. The shaft of an axially placed clamping screw 28 is screwed into a tapped hole in the clamping block 26, and its head bears on a web 27 welded diametrically across the tubular section 21. The clamping jaws 24 and the clamping block 26 together form a central conical clamping wedge arrangement in the head piece 21, which jointly acts radially on all the rods 30 and is adjustable from above by means of the clamping screw 28. When the screw 28 is slackened and the clamping block 26 is lowered, as shown on the right in FIG. 5, the clamping jaws 24 are released, and the rods can slide longitudinally; when the screw 28 is tightened and the clamping block 26 raised, as shown on the left in FIG. 5, all the rods 30 are clamped tight.

The conical clamping wedge described above can also made to clamp tight automatically when it is under load, by reversal of the direction of the conical sliding surface, i.e. with the cone reducing toward the bottom; the clamping block is then tightened against a web at the bottom end (not shown).

At the foot end, the rods 30 of the bases of the supports are made as partial spheres. Each rod is connected to a bearing plate with which it forms a ball-and-socket joint, and the spherical end of the rod is seated in a corresponding socket formed in the top 32 of the bearing plate which is made of expandable plastic material and snapped over the spherical end. The bottom of each bearing plate is a metal plate 33. In a preferred embodiment, the plastic tops 32 can be linked flexibly to each other to form a mobile ring, as shown on the right-hand side of FIG. 6. When the support is being adjusted, the base of a support made in this manner can readily adapt to a sloping or uneven subfloor 1 and ensures a reliable bearing for the support, because it maintains the intimate contact with the substrate, necessary for the positive transmission of the superimposed load; thereby the centreline 29 of the support is kept perfectly plumb. The bearing surface of the base to the support, i.e. the underside of the plates 33, should preferably be bonded to the subfloor 1 by adhesive material, for example a double-faced adhesive tape or an adhesive applied by spatula etc. Preferably, a perforated plate 34 or similar means should be provided to apply simultaneous and evenly distributed pressure on all the rods 30 as it presses on pinched-out lugs 35 on the rods, to ensure that, when the support is being adjusted and aligned, all the rods of a base are pressed tightly against the subfloor.

Figure 7:
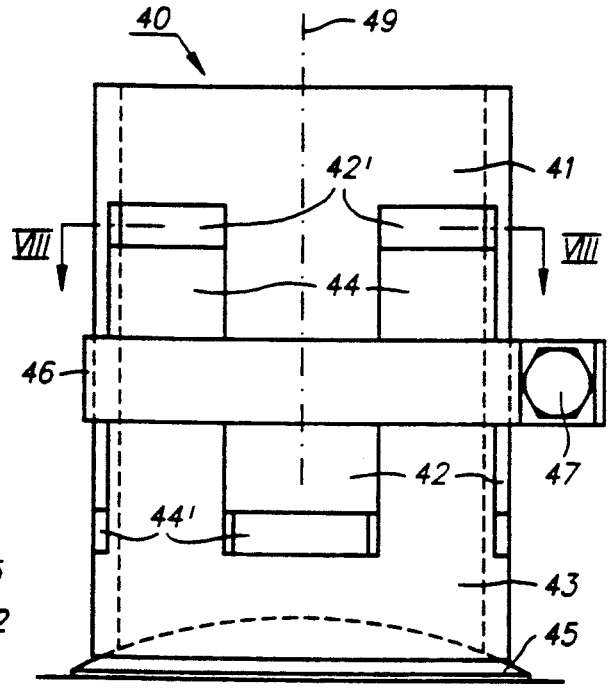
FIG. 7 is an elevation of a further embodiment of a support.
Figure 8:
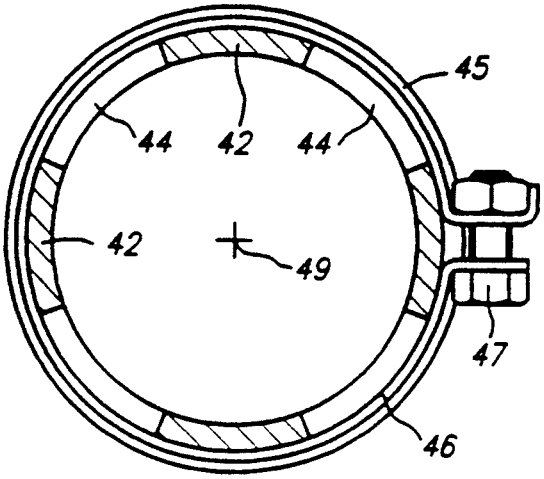
FIG. 8 is a horizontal section along line VIII—VIII in FIG. 7.

In the embodiment of an access-floor support 40 shown in FIG. 7 and 8, the head piece 41 and base 43 are made mainly of tubular sections of the same diameter. Distributed evenly around its circumference, each tubular section has alternating longitudinal notches 42' and 44' and tabs 42 and 44 of equal width. As shown, the tabs of one of the parts fit in the notches of the other part, thus again telescopically and loosely guiding the head piece 41 and base 43 relative to each other. A clamping strap 46 with a tensioning screw 47 encircles the parts of the two pieces which engage. When the height of the support has been adjusted, the two parts are firmly tightened against each other. The safety and loadbearing capacity of this embodiment can be increased by the provision of fine ribs and grooves running perpendicular to the tubular section's axis 49 on the outer face of the tabs 42 and 44, and on the inner face of the clamping strap 46 (not shown). Preferably, the tubular section 43 of the base should rest on a domed base-plate 45 to compensate for any slope in the subfloor.

Both telescopic supports 20 and 40 are perfectly suitable for use in the method described above. The height of these is continuously variable and can be easily adjusted, increased, or reduced without any need to turn a screw thread, and this is easily done jointly with a plurality of supports. The supports can then be permanently fixed in position without slack or backlash. Further, their design ensures a perfect, direct flow of forces to transmit the superimposed load from the floor panels to the subfloor and takes full account of the fact that the floor panels deflect (slightly) under load and are thus mainly supported by the edge zone of the upper tubular sections 21 and 41, i.e. on their upper and outer edge. Because most of the forces flow vertically from top to bottom, the supports are practically free from any bending stress.

In a further embodiment of a support 50, as shown in FIG. 9, the base 51 is designed as a cast component of concrete or other suitable material. It has an axial hole 52 open at the top. The head piece consists mainly of a screw shaft 53 and a head plate 54. A tapped sleeve 55 is riveted to the head plate 54. The shaft 53 screws into the sleeve 55 and is fixed by a locknut 56. As stated above, the height of the support 50 can be adjusted in a device 10 or 10A simply by alteration of the length of shaft 53 inserted in the base's hole 52. (It should be noted that such height adjustment is achieved with the locknut 56 tightened, i.e. not by any alteration of the length of shaft 53 screwed into the sleeve 55). The centreline 59 of the head piece is perpendicular to the ancillary plane 4 and, because of the ample clearance provided between the shaft 53 and the hole 52, the base can readily adapt to any unevenness or slope in the subfloor 1. The device 10, 10A determines the relative position of head piece and base which is then permanently fixed by means of adhesive 58.

None the less, the screwed connection between shaft 53 and sleeve 55 permits subsequent correction and adjustment of the bearing surfaces for the floor panels, should such prove necessary due to later settlement of the subfloor, local overload, etc.

Figure 10:
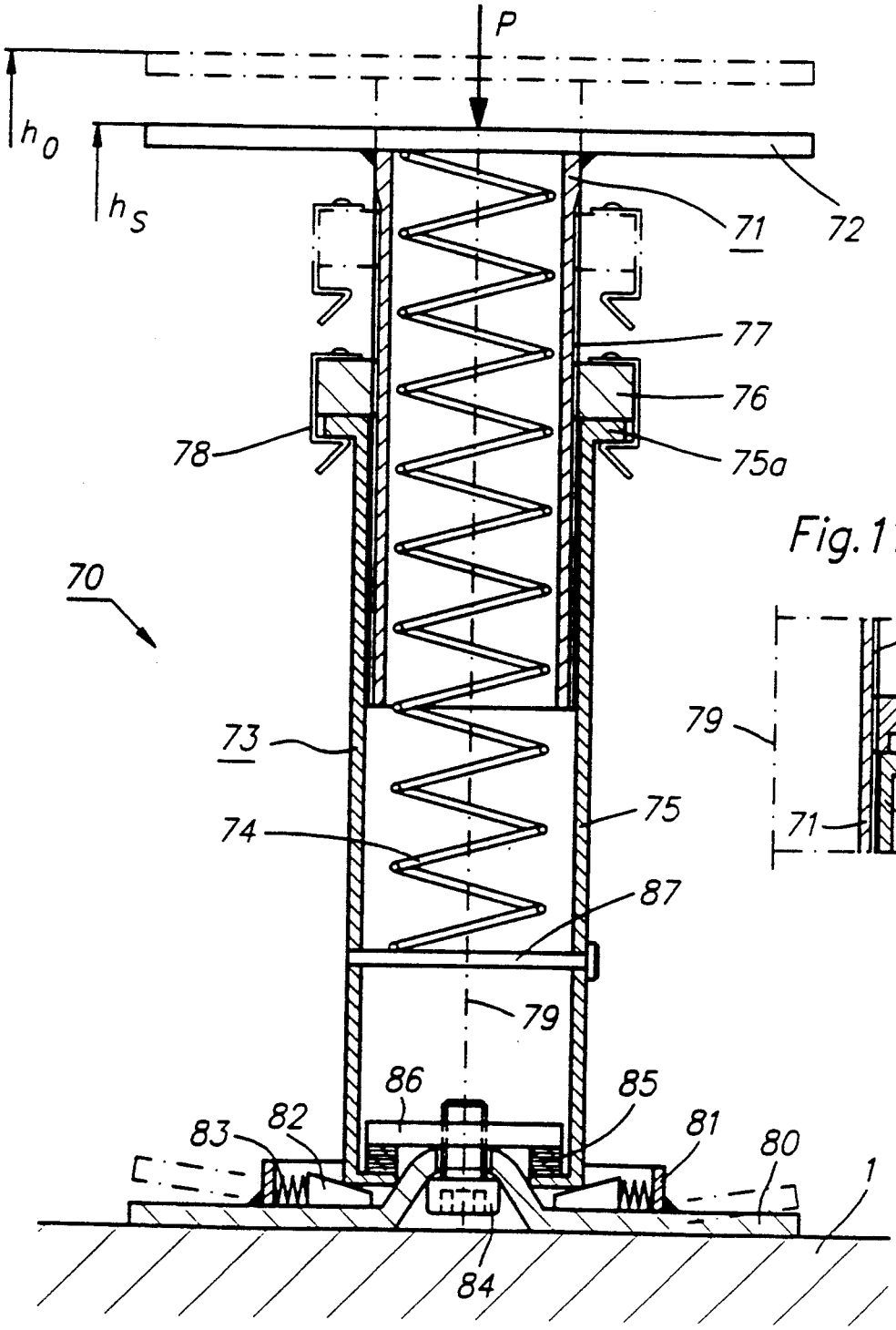
FIG. 10 is a vertical section of yet another embodiment of a support.

FIG. 10 shows a further embodiment of an access-floor support 70. Again, this support is specially designed for use in the method described above and with a device 10 or 10A, but it may also be used without such a device.

The access-floor support 70 shown in FIG. 10 has a head piece 71 and a base 73 which are adjustable axially relative to each other and thus permit the height adjustment of the support. The head piece 71 consists primarily of a tube provided with an external thread 77, to which a head plate may be welded. The tube of the head piece 71 is guided telescopically inside a tube 75 which forms part of the base, and can move up and down the base parallel to the axis 79. A baseplate 80, further described below, is connected by a movable joint to the telescopic tube 75 of the base 73. A compression spring 74 is fitted between the head piece 71 and the base 73; it may, for example, rest on a pin 87 at the bottom and bear against the head plate 72 at the top. When no load is applied, the effect of this spring 74 is to push the parts 71 and 73 apart, i.e. the support is kept too high at level $h_o$, as shown by a dashed line in FIG. 10. On its threaded length 77, the head piece 71 has an adjustable screw stop 76 made as a locking ring. At the beginning of the assembly or adjustment of the supports, this ring is placed near the top, also shown by a dashed line in FIG. 10.

When the support has been set up and fixed to the subfloor 1, it is adjusted from this position to its required height $h_s$. For this purpose, the parts 71 and 73 are pressed together in the direction indicated by arrow P, against the force of the spring, until the head plate is at the required height. As described above, a device 10 or 10A holds the support by its head piece, together with a group of other such supports which extend perpendicularly down from the ancillary plane defined by the device. When the device is being levelled, the supports are set up simultaneously on the subfloor 1 and their height reduced from the excess height $h_o$ to the required height $h_s$. However, each support can also be adjusted separately to the required height.

When the height of the support has been adjusted to the required measure, the screw stop 76 is screwed down on the external thread 77 until it abuts against the base 73 to fix the relative positions of head piece and base, so that the support can carry the floor load. Preferably, the top of the tube 75 has a flange **75*a*, against which the screwed-down locking ring can rest. To ensure that the support remains at the required height when it is not yet under load, for example before the floor panels are laid, some means of retention should be provided to act on this flange and the base when the locking ring is screwed down, to overcome the tendency of the spring 74 to force the parts 71 and 73 apart. For this purpose, as shown in FIG. 10, several snap springs may be fitted. When the ring 76 is screwed down, the springs 78 are pressed out, glide over the flange 75*a* and grip behind it, and thus hold the ring 76 hard against the flange 75*a***.

Figure 11:
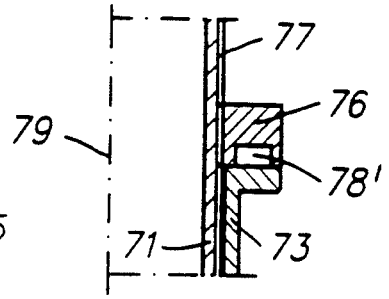
FIG. 11 is a vertical section in part which shows an alternative detail of an embodiment according to FIG. 10.

FIG. 11 shows a further embodiment of such retention means. In this case, instead of snap springs 78, one or more permanent magnets 78' (or a complete permanent ring magnet) are fitted to the underside of the locking ring 76. When the locking ring is screwed down, the magnets hold the ring 76 against the flange, so that, despite the compressed spring 74, the support remains at its required height. Whether such means of retention 78 or **78*a* are provided or not, the compressed spring 74 should be released once the support has been finally adjusted in height. A simple means of doing this is, for example, to ensure that the pin 87 fits loosely in the tube 75** and can be pulled out to release the spring when adjustment is complete.

When there is a large number of supports, manual screwing down of the locking rings 76 can be a lengthy and tiresome task. It may therefore prove desirable to turn the locking ring by means of a motor, for example a reversible motor (not shown) which drives a friction wheel or similar means which is held against the outside of the ring 76 and turns it on the external thread 77.

Obviously, a large number of alternative embodiments can be derived from FIG. 10 by reversal, for example by guiding the tube of the head piece on the outside of the base instead of inside it, having the screw thread and locking ring on the base instead of on the head piece, fitting the means of retention to the part opposite the locking ring, using a tension spring instead of a compression spring, etc.

The special shape of the baseplate 80 in FIG. 10 is designed to ensure that the support and its centreline 79 are always perfectly plumb, even when the baseplate 80 slopes in any direction due to unevenness of the subfloor. The baseplate 80 and the telescopic tube 75 of the base 73 are held together by a screw 84 and an anchor plate 86, and an elastic intermediate layer 85 between the anchor plate and an inner flange in the tube 75 gives the baseplate 80 a limited amount of tilt movement in any direction relative to the centreline 79, as indicated by dashed lines in FIG. 10. Inside the ring 81 on the upper surface of the plate 80, there are several supporting wedges 82, for example three or four, which can slide radially on the baseplate 80. These wedges 82 should preferably be pre-tensioned radially by means of springs, for example compression springs 83, supported on the ring 81. Thus, when the baseplate 80 bears on the subfloor 1 and is tilted in any direction, the centreline 79 of the support is always held plumb. Some of the wedges 82 are forced radially toward the centre to make up for the locally increased distance, until all the supporting wedges 82 provide a positive support along the whole of the tube's circumference. On completion of the assembly of the supports, a setting material should be poured into the space inside the ring 81 to fix the layout of the wedge system and the tilt setting obtained.

The above description refers to various embodiments of the laying or assembly method, the auxiliary device for carrying out the method, and the prefabricated access-floor supports. Attention is drawn to the fact that in addition to the combinations directly described, other combinations of method, device, and support are possible and readily apparent. The present disclosure expressly includes all these alternative combinations as far as they are deemed relevant.

I claim:

1. Method for laying access floors comprising floor panels (6) resting edge to edge on height-adjustable, load-bearing supports (5), said supports being set out in a regular grid pattern and standing on a subfloor, the method comprising the following steps:

an ancillary plane (4), extending over a field (3) comprising a plurality of grid points (2), is levelled at a distance above the subfloor (1);

prefabricated supports (5), each having a head piece (7) and a base (8), are introduced on said grid points (2) between the ancillary plane (4) and the subfloor (1);

said supports (5) at each of said grid points (2) are adjusted to the required height to suit the respective distance between the ancillary plane (4) and the subfloor, and the head piece (7) and base (8) of each said support (5) are fixed to each other;

and, finally, the floor panels (6) are laid onto the fixed supports (5).

2. The method according to claim 1, wherein at least a part of the supports (5) is positioned on the grid points (2) before the ancillary plane (4) is levelled.

3. The method according to claim 2, wherein the ancillary plane (4) is levelled by moving it closer to the subfloor (1) and at the same time the height of the supports (5) is adjusted by shortening them.

4. The method according to claim 1, wherein the height adjustment of the supports (5) is carried out after the ancillary plane (4) has been levelled, and is then effected by extending the supports (5) downward from the ancillary plane.

5. The method according to claim 1 wherein at least three supports (5) are first set up and adjusted in height in a marginal area of said field (3) in order to define the ancillary plane (4), and the other supports (5) in the field (3) are then introduced.

6. Device for laying access floors, said access floors having floor panels (6) resting edge to edge on height-adjustable, load-bearing prefabricated supports (5), said prefabricated supports being set out in a regular grid pattern and standing on a subfloor, said device comprising:

a frame (11) for defining an ancillary plane (4) over a field (3), said frame (11) having height-adjustable supporting means (16,16') for positioning said device (10) above said subfloor; and releasable attachment means (15,67) for releasably fixing head pieces (7) of said prefabricated supports (5) aligned in height with said ancillary plane (4) and extending perpendicularly therefrom at points (2') on said frame (11) corresponding to grid points (2) on said grid pattern.

7. Device according to claim 6, wherein outriggers (12) project laterally from said frame (11) and are provided with means (13) for positioning from adjacent supports (5) already set in position and with height-adjustable supporting legs (16, 16').

8. Device according to claim 7, wherein said supporting legs (16, 16') are removable.

9. Device according to claim 6, wherein levelling elements (17) are provided on said frame (11).

10. Device according to claim 6, wherein said frame (11) is designed as a rigidly braced grid resistant to twisting and bending.

11. Device according to claim 6, wherein said device comprises a bottom section (61) and a top section (65), said bottom section (61) having positioning means (12, 16) for positioning said device on said subfloor, stop means (62) for aligning bases (51) of said supports with said grid points (2), and centering means (63) for cooperation with and positioning of said top section (65), and said top section (65) having said releasable attachment means (67) for head pieces (53,54) of said supports, and supporting elements (66) for maintaining a predetermined distance from said bottom section (61).

12. Prefabricated access-floor support for use with a device for laying access floors, said floors having floor panels (5) resting edge to edge on a plurality of said prefabricated access-floor support said plurality of said prefabricated access-floor support being set out in a regular grid pattern and standing on a subfloor, said prefabricated support comprising:

a head piece (21,41,53,71) and a base (30,43,51,73) that for purpose of height adjustment of said support are adjustable relative to each other, wherein said head piece and said base are guided loosely relative to each other and are continuously adjustable in an axial direction (29,49,59,79) of said support without requiring rotation of either said head piece or said base, and in that the fixing means (24, 26; 46, 47; 58; 76, 78) are provided for permanently fixing a relative position of said head piece and said base.

13. Access-floor support according to claim 12, wherein said head piece (21) is mainly tubular in shape and said base has a plurality of rods (30) arranged parallel about a centreline (29) of said support, said rods being guided separately along a wall of said tubular head piece (21) and clamping means (24, 26) provided in said head piece for clamping said headpiece to said base.

14. Access-floor support according to claim 13, wherein said head piece (21) has a central conical clamping wedge arrangement (24, 26) acting radially upon all said rods (30) and being adjustable from above by means of an axially positioned clamping screw (28).

15. Access-floor support according to claim 13, wherein a foot end of each rod (30) of said rods is connected by a movable joint to a bearing plate (32, 33), each said bearing plate preferably being connected flexibly to each other to form an accommodating ring.

16. Access-floor support according to claim 13, having a common means for pressing (34) the base tightly against the subfloor.

17. Access-floor support according to claim 12, wherein said head piece (41) and said base (43) are formed mainly of tubular sections of a same diameter, each having alternating longitudinal notches (42', 44') and longitudinal tabs (42, 44) of equal width engaging mutually, said notches and said tabs of said head piece and said base being encircled by a clamping strap (46, 47).

18. Access-floor support according to claim 17, wherein said base (34) rests on a dome-shaped baseplate (45).

19. Access-floor support according to claim 12, wherein said base (51) has an axial hole (52) open at the top and said head piece has a shaft (53) which fits loosely into said hole (52), wherein said head piece and said base are subject to be fixed relative to each other by means of an adhesive or setting agent (58) introduced into said hole (52).

20. Access-floor support according to claim 19, wherein the shaft (53) has a screw thread and carries a head plate (54) whose height is subsequently adjustable by means of a tapped sleeve (55).

21. Access-floor support according to claim 12, wherein the head piece (71) is guided telescopically against said base (73) and is slidable axially (79) along said support, a spring (74) being compressed or tensioned between said head piece and said base (71, 73) such that, from an excess height ($h_o$) of said support, said head piece (71) can be slid against a force of said spring (74) in order to adjust said support to a required height ($h_s$), said head piece (71) having an adjustable screw stop (76) which, with said support adjusted to said required height ($h_s$), can be set on a screw thread (77) for abutment against said base (73) in order to carry a load imposed on said support.

22. Access-floor support according to claim 21, wherein means of retention (78, 78') are provided for acting between said screw stop (76) and said base (73) in order to overcome a force of said spring acting between said head piece and said base (71, 73) when said stop has been adjusted and said support is not under load.

23. Access-floor support according to claim 22, wherein said means of retention are formed by at least one snap spring (78).

24. Access-floor support according to claim 22, wherein said means of retention are formed by at least one permanent magnet (78').

25. Access-floor support according to claim 21, wherein, with said support being set at the required height, the tension or compression of the spring (74) between the two parts (71, 73) can be released.

26. Access-floor support according to claim 25, wherein a motor drive means is provided for setting the screw stop (76) along said screw thread.

27. Access-floor support according to claim 21 wherein said base (73) has a baseplate (80) connected to a telescopic part (75) by a movable joint, and has several supporting wedges (82) for and telescopic part (75), which are displaceable radially to ensure positive support for said telescopic part (75) at any tilt angle of the baseplate (80).

28. Access-floor support according to claim 27, wherein spring elements (83) are provided to act on said supporting wedges in order to pre-tension the wedges in a radial direction.

* * * * *